US007367380B2

(12) United States Patent
Lee et al.

(10) Patent No.: US 7,367,380 B2
(45) Date of Patent: May 6, 2008

(54) COIL TYPE TURN-FIN CONDENSER

(75) Inventors: Dong Ha Lee, Pyongtaek (KR); Mun Jae Im, Pyongtaek (KR)

(73) Assignee: Korea Bundy Corp., Pyongteak (KR)

( * ) Notice: Subject to any disclaimer, the term of this patent is extended or adjusted under 35 U.S.C. 154(b) by 411 days.

(21) Appl. No.: 10/835,689

(22) Filed: Apr. 29, 2004

(65) Prior Publication Data

US 2004/0216865 A1 Nov. 4, 2004

(30) Foreign Application Priority Data

Apr. 30, 2003 (KR) ..... 10-2003-0027386
Jan. 13, 2004 (KR) ..... 20-2004-0000857 U

(51) Int. Cl.

| | |
|---|---|
| ***F25D 19/00*** | (2006.01) |
| ***F25D 11/00*** | (2006.01) |
| ***F25B 39/04*** | (2006.01) |
| ***F28F 1/32*** | (2006.01) |
| ***F28F 9/00*** | (2006.01) |

(52) U.S. Cl. ..... 165/67; 165/68; 165/76; 165/125; 165/163; 165/162; 165/184; 62/428; 62/507

(58) Field of Classification Search ..... 165/125, 165/163, 184, 428, 429, 507, 508, 172, 76, 165/162, 178, 53, 67, 68; 62/428, 429, 507, 62/508

See application file for complete search history.

(56) References Cited

U.S. PATENT DOCUMENTS 1,635,869 A * 7/1927 Weisz ..... 165/77
1,709,176 A * 4/1929 Hyde ..... 165/125

(Continued)

FOREIGN PATENT DOCUMENTS

JP 10253225 A * 9/1998

(Continued)

OTHER PUBLICATIONS

Seah Group, "Oneism—Vision of KBC—A Leading World Famous Corporation with Technical Innovation," Presentation, Feb. 2004, 35 pages, Korea Bundy Co., Kyunggi-do Korea.

(Continued)

*Primary Examiner*—John K. Ford
(74) *Attorney, Agent, or Firm*—Thelen Reid Brown Raysman & Steiner

(57) ABSTRACT

Disclosed herein is a turn-fin condenser. The turn-fin condenser employs a turn-fin tube adhesively wound in a spiral shape around an outer surface of the tube in which refrigerant flows. The condenser comprises a coil type turn-fin tube 10 wound in a coil shape and fixed by inner and outer brackets 20 and 30 surrounding an outer peripheral surface of the coil type turn-fin tube, a motor 40 positioned in an inner space formed by the coil type turn-fin tube 10, a blowing fan 50 for taking ambient air in the coil type turn-fin tube 10 after being driven by the motor 40, and a tube wall 80 spirally wound with tube 11 extending out of the inner and outer brackets 20 and 30 at the rear side of the coil type turn-fin tube 10. The turn-fin condenser is easily manufactured and allows a greater quantity of air contact with turn-fins, thereby enhancing heat exchange efficiency.

6 Claims, 9 Drawing Sheets

U.S. PATENT DOCUMENTS

| | | | | | |
|---|---|---|---|---|---|
| 1,786,000 | A | * | 12/1930 | Bundy | 165/68 |
| 2,044,832 | A | * | 6/1936 | Child | 62/289 |
| 3,077,226 | A | * | 2/1963 | Matheny | 165/125 |
| 3,161,944 | A | * | 12/1964 | Schuler | 29/33 G |
| 4,231,421 | A | * | 11/1980 | Eaton et al. | 165/68 |
| 4,492,269 | A | * | 1/1985 | Jennings et al. | 165/172 |

FOREIGN PATENT DOCUMENTS

| | | | | |
|---|---|---|---|---|
| JP | 2000097535 | A | * | 4/2000 |

OTHER PUBLICATIONS

Seah Group, "Oneism—Vision of KBC—A Leading World Famous Corporation with Technical Innovation," Brochure, 2004, 26 pages, Korea Bundy Co., Kyunggi-do, Korea.

* cited by examiner

Prior Art

Prior Art

Prior Art

COIL TYPE TURN-FIN CONDENSER

PRIORITY REFERENCE TO PRIOR APPLICATIONS

This application claims benefit under 35 U.S.C. §119 of Korean Patent Application No. 10-2003-0027386, filed on Apr. 30, 2003, by inventors Dong-Ha LEE and Mun-Jae IM; and of Korean Utility Model Application No. 20-2004-0000857, filed on Jan. 13, 2004, by inventors Dong-Ha LEE and Mun-Jae IM.

BACKGROUND OF THE INVENTION

1. Field of the Invention

The present invention relates to a turn-fin condenser, and more particularly to a coil type turn-fin condenser, which is easily manufactured and includes a structure allowing a greater quantity of air to contact with turn-fins, thereby enhancing heat exchange efficiency.

2. Description of the Related Art

In general, a condenser in an air conditioner is used for radiating heat from a high-temperature, high-pressure vapor phase refrigerant discharged from a compressor and then liquefying the vapor phase refrigerant with a high pressure. In recent years, all major industrialized nations have been intensifying regulations on energy efficiency. As a result, as a method for significantly enhancing a cooling efficiency and reducing energy consumption in the field of refrigerators, freezers and air conditioners, a condenser using turn-fin tubes is mainly utilized instead of a heat exchanger having a wire-tube shape.

As shown in FIG. 1, a conventional turn-fin tube 1 includes a tube 1*a* in which the refrigerant flows, and turn-fins 1*b* attached to the outer peripheral surface of the tube 1*a* for promoting heat exchange between the refrigerant passing through the tube 1 and ambient air. The turn-fins 1*b* are wound in a spiral shape around the outer peripheral surface of the tube 1*a* to enlarge a contact area of ambient air. To achieve this, the turn-fins 1*a* are folded with an appropriate width and wound in the spiral shape adhesively around the outer peripheral surface of the tube 1*a*.

When the turn-fins 1*b* are adhesively wound around the tube 1*a* as described above, the turn-fins 1*b* can be more tightly adhered to the tube 1*a*, if necessary, by a brazing process to enhance thermal transfer efficiency.

FIGS. 2 and 3 show a bending type condenser using the general turn-fin tube 1, in which the turn-fin tube 1 is primarily bent with a zigzag shape and then the primarily bent turn-fin tube is secondarily bent for the tube to overlap with itself up and down.

The turn-fin tube 1 is fixed by upper and lower brackets 2*a* and 2*b* and provided with a motor 4 at the rear side thereof. The motor 4 connects with a blowing fan 5 for taking ambient air between the outer surfaces of the turn-fin tube 1.

The turn-fin tube 1 is attached with a shield cover 6 at the front side of the turn-fin tubes 1. The shield cover 6 shields the rear side of the turn-fin tubes 1, thereby increasing a blowing pressure. Thus, ambient air is taken between the sides of the turn-fin tube 1 with a strong pressure and flows out of the rear side of the tube 1 provided with the blowing fan 5 after passing through the inside of the condenser.

However, there are problems in that since the bending type condenser is manufactured by bending the turn-fin tube 1 twice in order of the primary bending and the secondary bending, the manufacturing process is complicated, and that since both the motor 4 and the blowing fan 5 provided for air to pass between the turn-fin tubes 1 are protruded outwardly, a large mounting space is required.

Further, when ambient air taken by the blowing fan 5 passes through the outer surfaces of the turn-fin tube 1, air has a large contact area with the turn-fins 1*b* by the turn-fin tube 1 bent forward and rearward as well as up and down, but due to the air resistance of the overlapped structure having many folds, a reduced quantity of ambient air contacts the turn-fin 1*b*, thereby reducing the thermal exchange efficiency.

SUMMARY OF THE INVENTION

The present invention has been made to solve the above problems, and it is an object of the present invention to provide a coil type turn-fin condenser, which has a large mounting space and allows an increased quantity of ambient air to contact turn-fins, thereby improving heat exchange efficiency.

In accordance with an aspect of the present invention, the above and other objects can be accomplished by the provision of a turn-fin condenser employing a turn-fin tube adhesively wound in a spiral shape around an outer surface of a tube in which refrigerant flows, the condenser comprising: a coil type turn-fin tube wound in a coil shape and fixed by inner and outer brackets surrounding an outer peripheral surface of the coil type turn-fin tube; a motor positioned in an inner space formed by the coil type turn-fin tube; a blowing fan for taking ambient air in the coil type turn-fin tube, the blowing fan being driven by the motor; and a tube wall spirally wound with tube extending out of the inner and outer brackets at a rear side of the coil type turn-fin tube.

Preferably, the tube wall is fixed to the inner bracket at opposite ends thereof and is supported by a fixing bracket attached with a plurality of clips for fixing the tube to one side of the tube wall.

Preferably, the inner bracket is provided with a plurality of fastening pins protruded in one direction, each fastening pin having a T-shaped end, and the outer bracket is provided with a plurality of fastening holes corresponding to the fastening pins, such that the inner and outer brackets are fastened to each other by twisting the end of each fastening pin passing through each fastening hole.

The outer bracket may be provided with a flange at one end thereof to fix the outer bracket to a frame.

The turn-fin condenser may further comprise: a horizontal bracket formed with fastening holes to be fixed to the outer bracket at an upper portion of the horizontal bracket and formed with a flange supported at one side of a lower portion of the horizontal bracket in order to horizontally fix the turn-fin condenser.

Preferably, the coil type turn-fin tube comprises an outer coil formed with gaps between adjacent outer surfaces of the outer coil for ambient air to pass between them, and an inner coil formed inside the outer coil to be separated from the outer coil and provided with gaps between adjacent outer surfaces of the inner coil for ambient air to pass between them.

The turn-fins may be wound around the tube with a pitch of 4 mm~6 mm.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Figure 1:
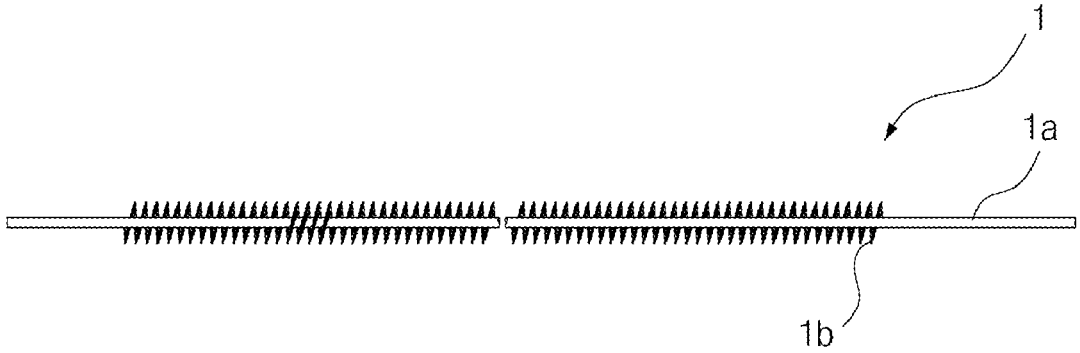
FIG. 1 is a schematic diagram of a conventional turn-fin tube.
Figure 2:
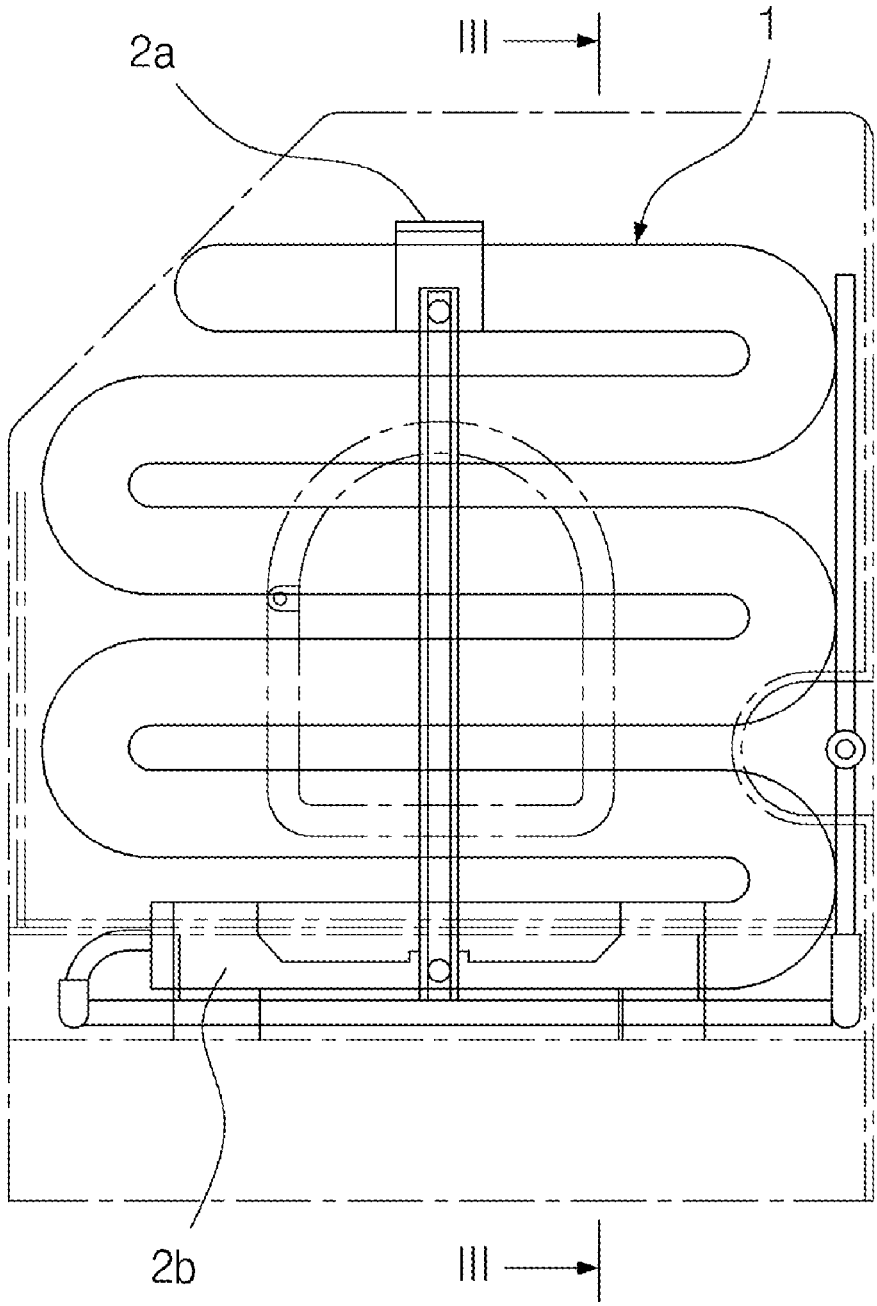
FIG. 2 is a side elevation of a bending type condenser using the turn-fin tube shown in FIG. 1.
Figure 3:
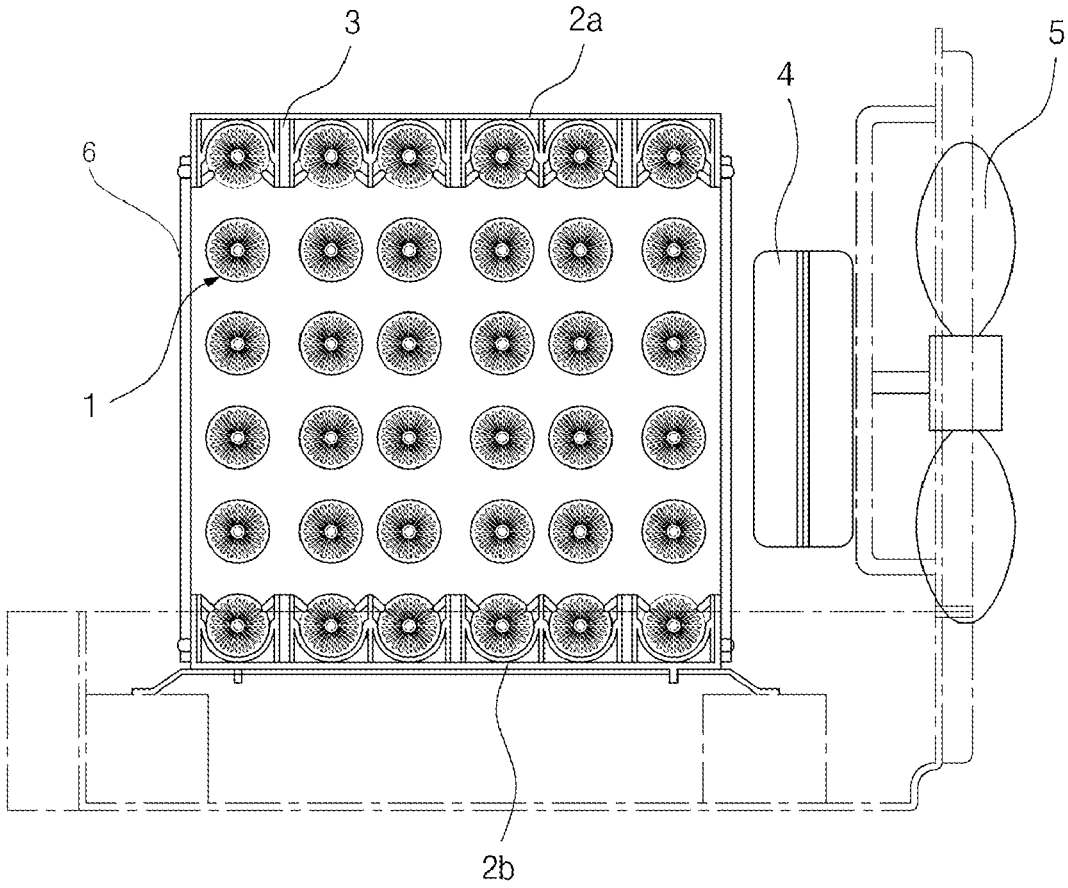
FIG. 3 is a plan view taken along line III-III of FIG. 2.

Preferred embodiments of the present invention will now be described in detail with reference to the accompanying drawings, in which like elements will be denoted by like reference numerals.

Embodiment 1

Figure 4:
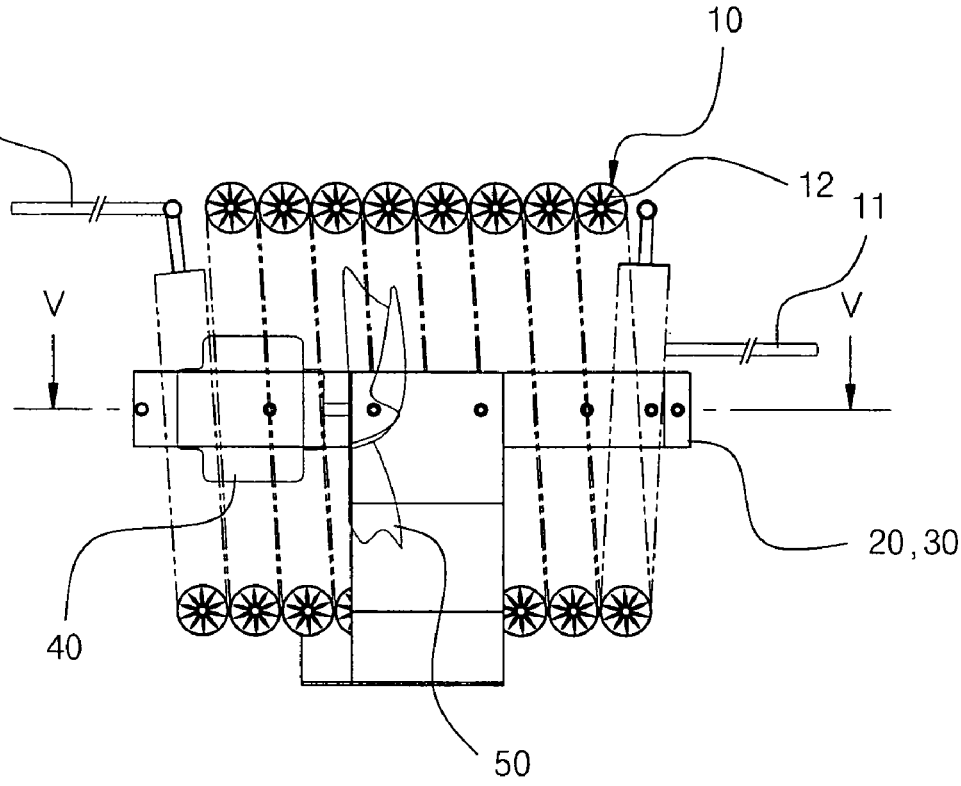
FIG. 4 is a diagram showing an appearance of a coil type turn-fin condenser according to the present invention.
Figure 5:
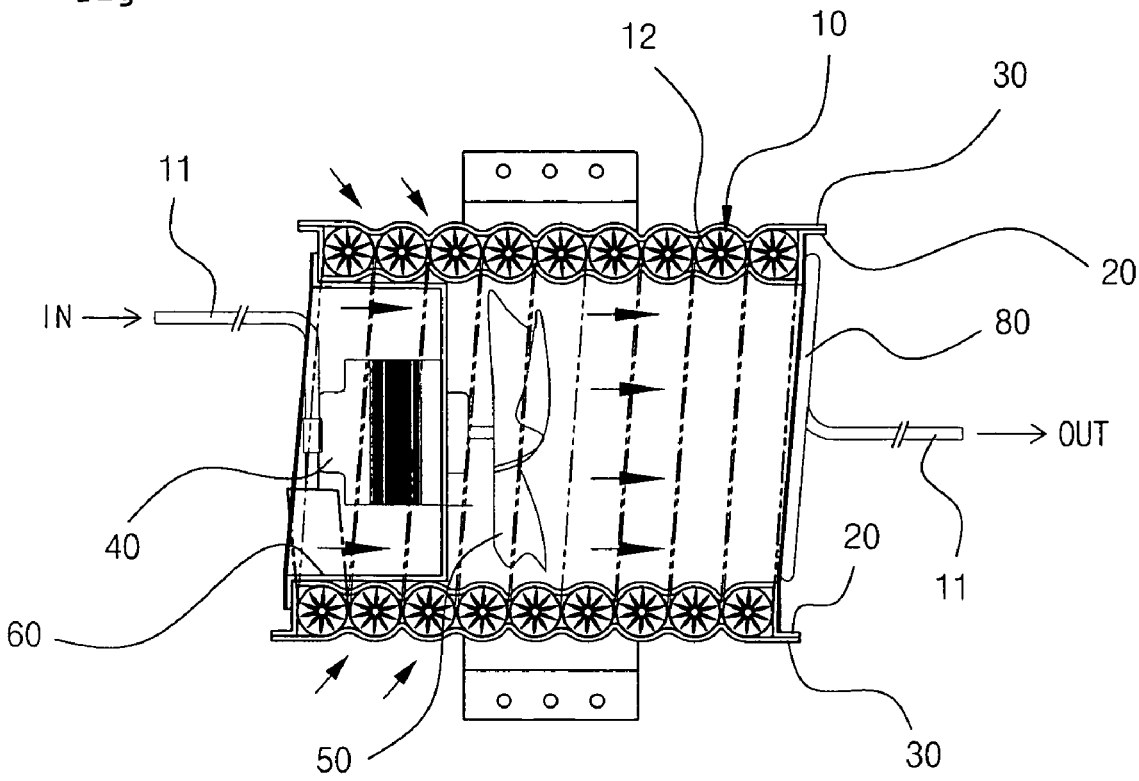
FIG. 5 is a plan view taken along line V-V of FIG. 4.

Referring to FIGS. 4 and 5, a coil type turn-fin condenser according to the present invention is provided with a turn-fin tube 10 with a circular coil shape (which will also be referred to as a "turn-fin tube coil" hereinafter) wound around a tube 11 in which refrigerant flows, on the periphery of which turn-fins 12 are adhesively wound in a spiral shape. The turn-fin tube 10 is provided with an inner bracket 20 and an outer bracket 30, both having a band shape, at the outer and inner surfaces of the turn-fin tube coil, respectively. The inner bracket 20 and an outer bracket 30 are repeatedly formed with arcuate grooves thereon for receiving the turn-fins 12, respectively.

In an inner space formed by the turn-fin tube coil 10, the coil type turn-fin condenser is mounted with a blowing fan 50 for taking ambient air inside the turn-fin tube coil and a motor 40 for driving the blowing fan 50. The motor 40 is provided in the inner space of the coil while being connected with a support plate 60 bent inward of the coil. The motor 40 is provided with the blowing fan 50 driven by the motor 40 for taking ambient air in the coil through the outer surfaces of the coil. The support plate 60 is fixed to the inner bracket 20 at one side of the inner bracket 20. In the present embodiment, an example in which the motor 40 is provided at the front side of the turn-fin tube coil is illustrated.

As the inner bracket 20 and the outer bracket 30 are in contact with the turn-fin tube 10 at one side of the turn-fin tube coil 10, respectively, with a band shape, ambient air can be taken in the coil through gaps between the outer surfaces of the coil, which is not shielded by the inner and outer brackets 20 and 30.

Figure 6:
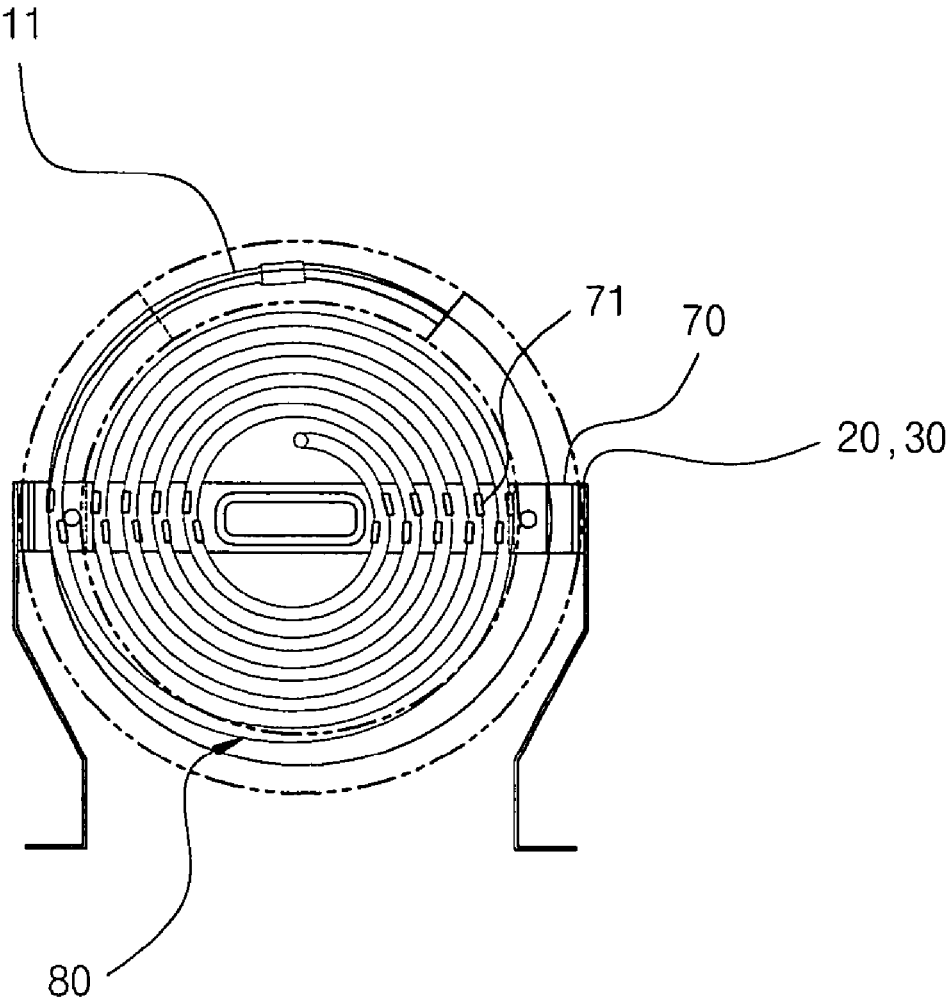
FIG. 6 is a side elevation of the coil type turn-fin condenser according to the present invention.

As shown in FIG. 6, the turn-fin tube coil 10 is provided, at the rear thereof, with a spirally wound tube wall 80 for maximizing a contact area of ambient air with the tube 11 extending out of the inner and outer brackets 20 and 30. The tube wall 80 can have a zigzag shape. The tube wall 80 is preferably supported by a fixing bracket 70 connected with one side of the inner bracket 20 at opposite ends of the fixing bracket.

The fixing bracket 70 is mounted to the rear side of the turn-fin tube 10 to traverse both sides thereof, and is attached with a plurality of clips 71 for fixing respective portions of the tube 11 constituting the tube wall 80. The clips 71 allow a smooth flow of the refrigerant in the tube 11 by preventing the movement of the tube wall 80 caused by a rapid discharge of ambient air toward the rear side of the turn-fin tube 10.

In accordance with the present invention, the blowing fan 50 and the motor 40 are provided at the front side of the space formed inside the coil of the turn-fin tube 10, so that the mounting space for the total condenser can be reduced.

Further, since ambient air can be easily taken through gaps between the outer surfaces of the turn-fin tube coil of a single layer inside the coil type turn-fin condenser, not only ambient air passing through the gaps between the coils uniformly contacts with total circumference of the turn-fin tubes 12, but also it is subjected to a much lower air resistance by the turn-fin tube 10 than the conventional bending type turn-fin condenser. Thus, heat exchange between the refrigerant flowing in the tube and ambient air can be effectively achieved.

Particularly, since the heat from ambient air taken in the turn-fin tubes 10 is exchanged again when air passes through the tube wall 80 at the rear side, the heat exchange efficiency may be further enhanced.

Figure 7:
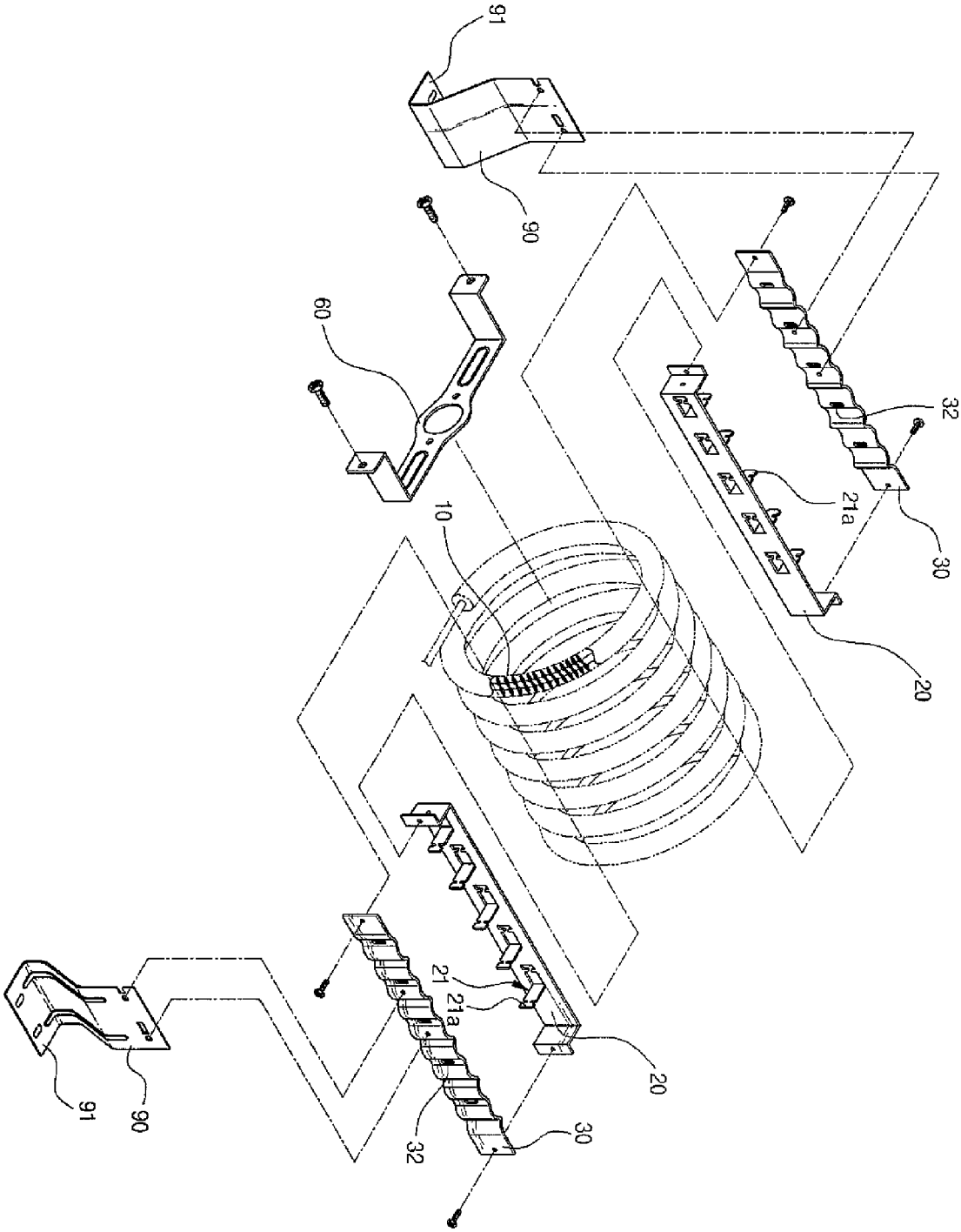
FIG. 7 is an exploded perspective view showing a combined state of another embodiment of inner and outer brackets of the present invention.

Meanwhile, as another embodiment of the inner and outer brackets for allowing easy fastening between the inner and outer brackets, as shown in FIG. 7, the inner bracket 20 is provided with a plurality of fastening pins 21, each of which has a "T"-shaped end protruded toward the outer bracket 30 with a predetermined space, and the outer bracket 30 is provided, at the arcuate grooves, with fastening holes 32 corresponding to the fastening pins 21 with a predetermined space.

When mounting the inner and outer brackets 20 and 30 constituted as described above, the inner and outer brackets 20 and 30 can be very easily connected with each other by twisting the end 21*a* of each fastening pin after penetrating each fastening pin 21 of the inner bracket 20 through each fastening hole 32 of the outer bracket 30.

Figure 8A:
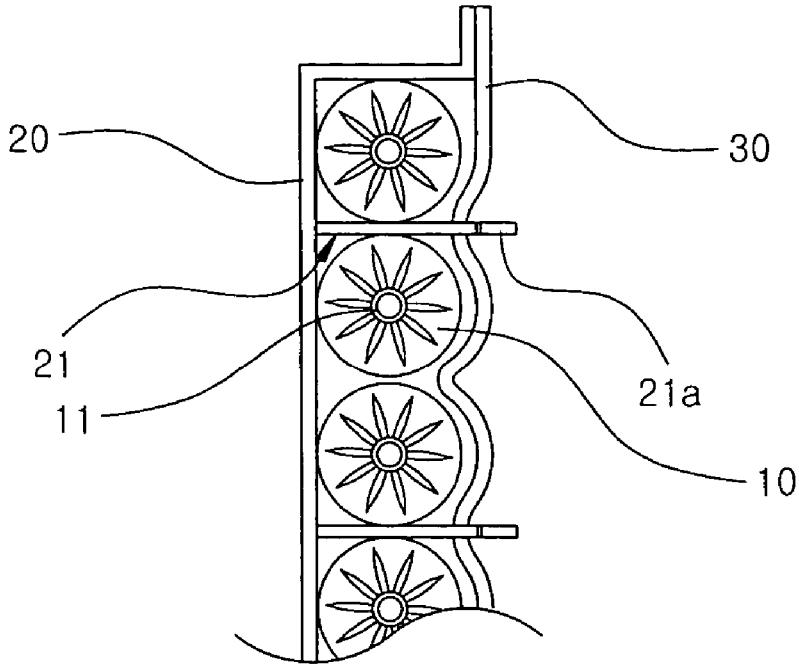
FIGS. 8*a* and 8*b* are partial detail views showing a combined state of the inner and outer brackets of FIG. 7, respectively.

Specifically, as shown in FIG. 8*a*, the inner and outer brackets 20 and 30 are positioned at inner and outer surfaces of the condenser, respectively, such that the end 21*a* of each fastening pin 21 of the inner bracket 20 passes between the outer surfaces of the turn-fin tube 10 to penetrate each fastening hole 32 of the outer bracket 30. Then, the turn-fin tube is fixed between the inner bracket 20 and the outer bracket 30 by twisting or turning the ends 21*a* of the fastening pins 21 penetrating the fastening holes 32, respectively.

Figure 8B:
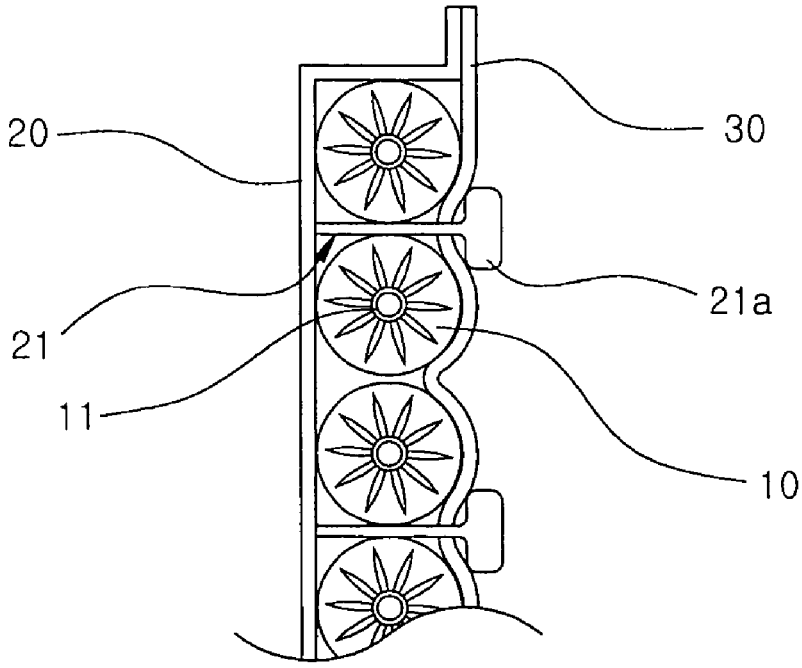

In an initial state, the inner bracket 20 and the outer bracket 30 do not adhesively contact each other due to the arcuate grooves formed between the adjacent outer surfaces of the turn-fin tube 10. However, as shown in FIG. 8*b*, when the ends 21*a* of the fastening pins 21 are twisted, opposite ends of an upper portion of each fastening pin 21 push down a slope surface of the outer bracket 30, so that the inner bracket 20 and the outer bracket 30 may adhesively contact each other in natural.

Meanwhile, at one end of the outer bracket 30, there is provided a flange 33 bent outwardly for fixing the turn-fin condenser comprising the turn-fin tube 10 and the blowing fan 50 to a frame (not shown).

Further, the turn-fin condenser may further comprises a horizontal bracket 90, which is formed with a combining hole for horizontally fixing the condenser to the outer bracket 30 at an upper portion of the horizontal bracket and formed, at a lower portion thereof, with a flange 91 supported at one side.

Further, the outer bracket and the inner bracket 20 and 30 are formed with combining holes at opposite ends thereof, respectively, to be combined with each other by bolts or screws.

Embodiment 2

Figure 9:
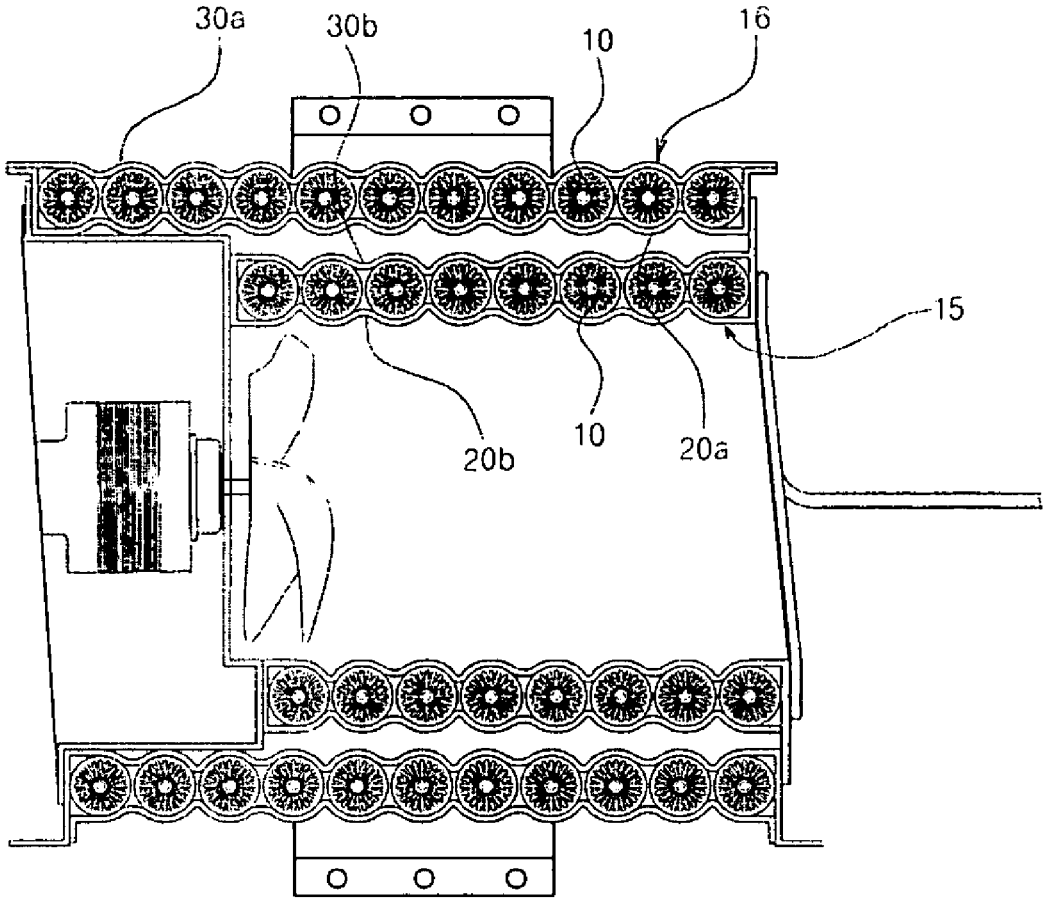
FIG. 9 is a sectional side elevation of construction of a multi-coil type turn-fin condenser according to another embodiment of the present invention.

Referring to FIG. 9, a coil type turn-fin condenser according to the present invention is provided with multiple coils comprised of an inner coil 15 and an outer coil 16 to enhance heat exchange efficiency of the condenser.

Each of the inner and outer coils 15 and 16 is formed by the turn-fin tube 10 wound around the tube 11 in which a heat exchange medium flows, around the periphery of which the turn-fins 12 are adhesively wound in a spiral shape.

Except the inner and outer coils 15 and 16, Embodiment 2 has the same components as that of Embodiment 1. Thus, a detailed description of identical components will be omitted hereinafter.

The outer coil 16 is formed with gaps between the adjacent outer surfaces of the coil for ambient air to pass through the adjacent outer surfaces thereof, and the inner coil 15 is formed inside the outer coil 16 to be separated from the outer coil 16 by a predetermined distance. The inner coil 15 is also formed with the gaps between the adjacent outer surfaces of the coil for ambient air to pass through the adjacent outer surfaces thereof.

Thus, ambient air can be taken in the coils through a space between the outer coil 16 and the inner coil 15 fixed by brackets 20*a* and 20*b*; 30*a* and 30*b*, respectively. That is, since the brackets 20*a* and 20*b*; 30*a* and 30*b* are formed in a band shape, ambient air may be taken in the coils through the spaces between the coils 15 and 16 which are not shielded by the brackets 20*a* and 20*b*; 30*a* and 30*b*.

Although the present invention is described using the example of the dual-coil type turn-fin condenser, the coil of the turn-fin tube can be constituted as other multi-coil types without being limited to the dual-coil type.

With the multi-coil type turn-fin condenser having the above constitution, heat exchange occurs over an increased cross-sectional area of the coils of the turn-fin tube within the same mounting spaces, so that heat exchange efficiency can be enhanced and at the same time a large capacity condenser can be manufactured.

Meanwhile, Table 1 set forth below shows the result of experiments to determine the radiation quantity of the turn-fin tube 10, each of turn-fin tube 10 being provided the turn fins having a different pitch for the same coil type turn-fin condenser. As can be seen from the results, the turn-fins 12 of the present invention preferably have a pitch of 4 mm~6

Specifically, with the turn-fins having a pitch of 6 mm or more, the number of turn-fins wound around the tube 11 is insufficient, thereby reducing radiation efficiency, whereas with the turn-fins having a pitch of 4 mm or less, the turn-fins 12 are formed with exceedingly narrow intervals so that air, from which the heat is radiated, is not smoothly discharged out of the condenser, thereby reducing the radiation efficiency.

In the experiments, air passing through the turn-fins 12 was maintained at constant flow rate, humidity, temperature, etc., and a radiation quantity using the turn-fins was calculated by measuring temperatures of water flowing in the tube 11, respectively, at inlet and outlet portions of the tube.

TABLE 1

| Item | | Ex. 1 | Ex. 2 | Ex. 3 | Ex. 4 | Ex. 5 |
|---|---|---|---|---|---|---|
| Volume | | 215 × 230 | 215 × 230 | 215 × 230 | 215 × 230 | 215 × 230 |
| Tube | D (mm) | 4.76 | 4.76 | 4.76 | 4.76 | 4.76 |
| | L (mm) | 7200 | 7200 | 7200 | 7200 | 7200 |
| | Material | Steel | Steel | Steel | Steel | Steel |
| Fin | Size (Φ × mm) | 8 × 64 | 8 × 64 | 8 × 64 | 8 × 64 | 8 × 64 |
| | Pitch (mm) | 7.0 | 6.0 | 5.0 | 4.0 | 3.0 |
| | Material | Steel | Steel | Steel | Steel | Steel |
| Radiation Quanty (Kcal/h) | | 230 | 264 | 279 | 288 | 255 |

As apparent from the description of Embodiments 1 and 2, in accordance with the present invention, the reduced mounting space is ensured in the coil type condenser of the present invention by mounting the blowing fan and the motor within the space formed by the coil of the turn-fin tube, thereby providing a small-sized heat exchanger.

Particularly, instead of the shield cover used in the conventional bending type turn-fin tube, the spiral-shaped tube wall maximizing the heat exchange area is formed, thereby enhancing the heat exchange efficiency.

Further, the outer bracket and the inner bracket are connected with each other by twisting the ends of the fastening pins of the inner bracket penetrating the fastening holes of the outer bracket, so that an easy combination of the outer bracket with the inner bracket can be provided along with enhanced fastening force.

Further, with the multiple coils of the inner and outer coils of the turn-fin tube, enhanced heat exchange efficiency can be provided concurrently with a large capacity condenser.

It should be understood that the embodiments and the accompanying drawings as described above have been described for illustrative purposes and the present invention is limited only by the following claims. Further, those skilled in the art will appreciate that various modifications, additions and substitutions are allowed without departing from the scope and spirit of the invention as set forth in the accompanying claims.

What is claimed is:

1. A turn-fin condenser employing a turn-fin tube adhesively wound with a turn-fin in a spiral shape around an outer surface of a tube in which refrigerant flows, the condenser comprising:

a turn-fin tube coil wound in a coil shape and fixed by inner and outer brackets surrounding an outer peripheral surface of the turn-fin tube coil;

a motor positioned in an inner space formed by the turn-fin tube coil;

a blowing fan for taking ambient air into the turn-fin tube coil after being passed by the motor;

a spirally wound tube wall formed of the tube extending out of a rear side of the turn-fin tube coil fixed by the inner and outer brackets, the tube wall in communication with the rear side of the turn-fin tube coil, wherein the tube wall is supported by a fixing bracket that is fixed to the both ends of the inner bracket, and the fixing bracket includes a plurality of clips for clipping and fixing the tube of the tube wall.

2. The turn-fin condenser as set forth in claim 1, wherein the inner bracket is provided with a plurality of fastening pins protruded in one direction, each fastening pin having a T-shaped end, and the outer bracket is provided with a plurality of fastening holes corresponding to the fastening pins, respectively, such that the inner and outer brackets are fastened to each other by twisting the end of each fastening pin passing through each fastening hole.

3. The turn-fin condenser as set forth in claim 1, wherein the outer bracket is provided with a flange at one end thereof to fix the outer bracket to a frame.

4. The turn-fin condenser as set forth in claim 1, the condenser farther comprising:

a horizontal bracket formed with fastening holes to be fixed to the outer bracket at an upper portion of the horizontal bracket and formed with a flange supported at one side of a lower portion of the horizontal bracket in order to horizontally fix the turn-fin condenser.

5. The turn-fin condenser as set forth in claim 1, wherein the coil type turn-fin tube comprises an outer coil formed with gaps between adjacent outer surfaces of the outer coil for ambient air to pass between them and an inner coil formed inside the outer coil to be separated from the outer coil and provided with gaps between adjacent outer surfaces of the inner coil for ambient air to pass between them.

6. The turn-fin condenser as set forth in claim 1, wherein the turn-fins are wound around the tube with a pitch of 4 mm~6 mm.

* * * * *